US007700540B2

(12) United States Patent
Scheuing et al.

(10) Patent No.: US 7,700,540 B2
(45) Date of Patent: Apr. 20, 2010

(54) HARD SURFACE CLEANING COMPOSITION

(75) Inventors: David R. Scheuing, Danville, CA (US); Malcolm A. Deleo, Livermore, CA (US); Aram Garabedian, Jr., Fremont, CA (US); Sara Morales, Pittsburg, CA (US)

(73) Assignee: The Clorox Company, Oakland, CA (US)

( * ) Notice: Subject to any disclaimer, the term of this patent is extended or adjusted under 35 U.S.C. 154(b) by 512 days.

(21) Appl. No.: 11/609,726

(22) Filed: Dec. 12, 2006

(65) Prior Publication Data

US 2007/0099816 A1 May 3, 2007

Related U.S. Application Data

(63) Continuation-in-part of application No. 10/263,605, filed on Oct. 2, 2002, now Pat. No. 6,926,745, which is a continuation-in-part of application No. 10/150,363, filed on May 17, 2002, now abandoned.

(51) Int. Cl.
*C11D 3/37* (2006.01)
*C11D 1/66* (2006.01)

(52) U.S. Cl. ..... 510/475; 510/238; 510/240; 510/477

(58) Field of Classification Search ..... 510/238, 510/240, 475, 477
See application file for complete search history.

(56) References Cited

U.S. PATENT DOCUMENTS

| | | | | |
|---|---|---|---|---|
| 2,798,047 | A | 7/1957 | Touey et al. | |
| 4,353,745 | A | 10/1982 | Ebbeler | |
| 4,622,075 | A | 11/1986 | Bogner | |
| 5,403,883 | A * | 4/1995 | Messner et al. | 524/458 |
| 5,409,639 | A | 4/1995 | Fusiak et al. | |
| 5,547,612 | A | 8/1996 | Austin et al. | |
| 5,693,716 | A | 12/1997 | Bott et al. | |
| 6,242,046 | B1 | 6/2001 | Nakane et al. | |
| 6,251,849 | B1 | 6/2001 | Jeschke et al. | |
| 6,331,517 | B1 | 12/2001 | Durbut | |
| 6,433,053 | B1 | 8/2002 | Kasturi et al. | |
| 6,703,358 | B1 * | 3/2004 | Aubay et al. | 510/434 |
| 2003/0017960 | A1 | 1/2003 | Bertrem et al. | |
| 2003/0045439 | A1 | 3/2003 | Evers | |
| 2003/0220223 | A1 * | 11/2003 | Scheuing et al. | 510/475 |

FOREIGN PATENT DOCUMENTS

| | | |
|---|---|---|
| EP | 0 467 472 A2 | 1/1992 |
| EP | 0 859 046 B1 | 8/1998 |
| EP | 1 362 907 | 11/2003 |
| WO | WO 96/00251 | 4/1996 |
| WO | WO 00/29538 | 5/2000 |
| WO | WO 00/77143 | 12/2000 |
| WO | WO 01/05920 | 1/2001 |
| WO | WO 02/18531 | 3/2002 |

* cited by examiner

*Primary Examiner*—Brian P Mruk
(74) *Attorney, Agent, or Firm*—Erin Collins

(57) ABSTRACT

Cleaning compositions which enhance hard surfaces to exhibit excellent water-spreading and oil-repellency and therefore provide a "next time easier cleaning" consumer benefit contain selected copolymers capable of forming invisible, extremely thin hydrophilic films on treated surfaces. The cleaning compositions feature a water-soluble or water-dispersible copolymer having a first monomer capable of forming a cationic charge on protonation and a second monomer that is acidic and that is capable of forming an anionic charge in the compositions, and may contain an optional third monomer having an uncharged hydrophilic group and/or an optional fourth monomer that is hydrophobic. The cleaning compositions may further contain functional ingredients including surfactants, organic solvents and/or other optional adjuvants to enhance the cleaning performance and aid in preparation of the surface for effective delivery of the copolymer during a cleaning operation.

12 Claims, No Drawings

HARD SURFACE CLEANING COMPOSITION

REFERENCE TO RELATED APPLICATIONS

This application is a continuation-in-part application of U.S. patent application Ser. No. 10/263,605 filed on Oct. 2, 2002, now, issued, as U.S. Pat. No. 6,926,745, which is a continuation-in-part of U.S. patent application Ser. No. 10/150,363 filed on May 17, 2002, now abandoned, all of which are hereby incorporated herein by reference.

FIELD OF THE INVENTION

The invention is directed to an improved cleaning composition for hard surfaces whereby treated surfaces exhibit excellent water-spreading and oil-repellence even after the surfaces have been rinsed several times with water. Thus treated household surfaces, for example, will remain clean for a longer period of time owing to deposition of an invisible copolymer film that exhibits extremely low water contact angles.

BACKGROUND OF THE INVENTION

Consumers are dissatisfied with their cleaner's ability to prevent soils, such as soap scum, toothpaste, hard water, greasy soils, brake dust, grime, rust, and toilet ring, from building up on household surfaces. Specifically, consumers want surfaces to maintain their cleaned look for longer periods of time.

One approach to solving this problem entails applying a sacrificial layer of material which is dissolvable by water with the attendant removal of dirt. Suitable cleaning formulations must be carefully applied in order to create a sufficiently thick, dry sacrificial film. Unfortunately, inconsistent consumer cleaning habits make this an almost impossible task. In many cases, the surface is rinsed before the film is dried thereby creating a sacrificial coating that is too thin to prevent soils from adhering. In cases where the sacrificial coating is too thick, an unsightly macroscopic film with visible residue is created.

U.S. Pat. No. 6,331,517 to Durbut describes an aqueous glass cleaning composition comprising an anionic surfactant and a hydrophilic, anionic maleic acid-olefin copolymer. The surface becomes hydrophilic such that the initial contact angle of water on the treated surface is from 12 to 23 degrees. While the presence of the copolymer yields an efficient hydrophilic surface coating, this sacrificial coating is easily rinsed away unless it is very thick.

U.S. Pat. No. 6,242,046 to Nakane et al. describes a more permanent stain-proofing treatment that employs a non-water soluble resin and a metal oxide sol. With this treatment, the surface must be washed with water before the film dries on the surface. This step appears to homogeneously spread a stain-proof-treating agent on the surface and removes excess stain-proof-treating agents. When washing with water is not done properly, however, the excess causes surface non-uniformity.

WO 00/77143 to Sherry et al. describes a surface substantive polymer which purportedly renders treated surfaces hydrophilic. The preferred polymers include a copolymer of N-vinylimidazole N-vinylpyrrolidone (PVPVI), a quaternized vinyl pyrrolidone/di-alkylaminoalkyl acrylate or methacrylate copolymer, or a polyvinylpyridine-N-oxide homopolymer. These polymers are purported to modify the surface to achieve water to treated surface contact angles of around 50 degrees.

U.S. Pat. No. 6,251,849 to Jeschke et al. describes a cleaner for easier next time cleaning that contains a cationic polymer comprising at least 40 mole percent of a quarternary monomer such as methacrylamidopropyl trimethylammonium chloride. The cleaning performance is said to improve with the presence of these polymers in the cleaner but it is expected that the wetting properties will decline after a single rinse step.

A second approach to preventing soil buildup is to deposit a release aid on the treated surface to modify surface characteristics. Unfortunately, the application of cleaner or water causes the soluble release aid to be completely removed. WO 02/18531 to Ashcroft et al. describes the use of cleaning solutions containing antioxidants that function as soil release agents. The antioxidants are purportedly retained on the surface so that soil subsequently deposited thereon is prevented from polymerizing thereby allowing for easier removal. However, it is expected that the antioxidants will not be effective on all soil types.

WO 00/29538 to Baker et al. describes a non-greasy sacrificial coating containing cellulose or gum and a release aid, such as lecithin. While this coating prevents sticking, its visual appearance makes it unsuitable for glass, counter-tops, showers and the like.

In view of the deficiencies of past endeavors in developing cleaning compositions that leave satisfactory low maintenance treated surfaces, the art is in search of cleaning compositions that provide a thin, stable invisible film that facilitates removal of a variety of soils. The cleaning composition should be suitable for household surfaces and should be rapidly adsorbed on the surface to yield a uniform film that causes water to sheet off and oil to roll off.

SUMMARY OF THE INVENTION

The present invention is based in part on the discovery of cleaning compositions which cause treated surfaces to exhibit excellent water-spreading and oil-repellence. In addition, the water-spreading and oil-repellence characteristics remain in effect even after the surface is subsequently rinsed several times with water. The cleaning compositions contain copolymers which develop a thin film of the copolymer on the surface thereby changing the surface properties. Thus by using the inventive cleaning composition, a consumer is able to attain a "next time easier cleaning" benefit, in which the consumer needs only use water, for example, in a sponge or paper towel to clean a "liquid oil" or water soluble soil from the treated surface. Consumers will notice the "water sheeting" and the improved water drainage that are attendant to treated surfaces. The efficient drainage of water off the surfaces results in a mechanical transport of dirt particles, soap and soap scum particles off non-horizontal surfaces, keeping them "cleaner, longer". These benefits are derived from the adsorbed layer of polymer that retards oil drop spreading and increases wetting by plain water exposure.

In one aspect, the invention is directed to an aqueous liquid cleaning composition for hard surfaces that includes:

(a) a water-soluble or water-dispersible copolymer having:

(i) a first monomer that is capable of forming a cationic charge on protonation selected from the group consisting of an N-alkyl acrylamide, N-alkyl(alkyl)acrylamide, N-aryl acrylamide, N-aryl(alkyl)acrylamide, N-alkyl (aryl)acrylamide, N,N-di-alkyl acrylamide, N,N-di-alkyl(alkyl)acrylamide, N,N-di-alkyl(aryl)acrylamide, N,N-di-aryl acrylamide, N,N-di-aryl(alkyl)acrylamide, N,N-di-aryl(aryl)acrylamide, N-alkylamino alkyl acrylamide, N-alkylamino alkyl(alkyl)acrylamide, N-alkylamino alkyl(aryl)acrylamide, N-arylamino alkyl acrylamide, N-arylamino alkyl(alkyl)acrylamide, N-arylamino alkyl(aryl)acrylamide, N,N-di-alkylamino alkyl acrylamide, N,N-di-alkylamino alkyl(alkyl)acrylamide, N,N-di-alkylamino alkyl(aryl)acrylamide, N,N-di-arylamino alkyl acrylamide, N,N-di-arylamino alkyl (alkyl)acrylamide, N,N-di-arylamino alkyl(aryl) acrylamide, and combinations thereof, wherein said alkyl moiety is a radical independently selected from the group consisting of a C1 to C6 saturated alkyl, vinyl, C3 to C6 unsaturated alkylene radical, and combinations thereof, wherein said aryl moiety is a radical independently selected from the group consisting of a benzyl, phenyl, styryl, hydroxyphenyl, alkylbenzyl, alkylphenyl radical, and combinations thereof;

(ii) second monomer that is acidic and that is capable of forming an anionic charge in the compositions;

(iii) optionally, a third monomer that has an uncharged hydrophilic group; and (iv) optionally, a fourth monomer that is hydrophobic;

(b) optionally, an organic solvent; and (c) a surfactant; and (d) optionally, an adjuvant;

wherein said copolymer is capable of forming an invisible film on a treated surface exhibiting a water contact angle of less than 10 degrees and a thickness of less than about 100 nm on said treated surface after a cleaning operation.

In another aspect, the invention is directed to a method of cleaning a hard surface and depositing an invisible protective copolymer film that comprises the steps of:

(a) applying a cleaning composition comprising a water-soluble or water dispersible copolymer onto the hard surface;

(b) removing the cleaning composition whereby a layer of such cleaning composition remains on the hard surface; and (c) allowing the layer to dry to thereby leave a copolymer film on the hard surface which contains the copolymer; wherein said copolymer has:

(i) a first monomer that is capable of forming a cationic charge on protonation selected from the group consisting of an N-alkyl acrylamide, N-alkyl(alkyl)acrylamide, N-aryl acrylamide, N-aryl(alkyl)acrylamide, N-alkyl (aryl)acrylamide, N,N-di-alkyl acrylamide, N,N-di-alkyl(alkyl)acrylamide, N,N-di-alkyl(aryl)acrylamide, N,N-di-aryl acrylamide, N,N-di-aryl(alkyl)acrylamide, N,N-di-aryl(aryl)acrylamide, N-alkylamino alkyl acrylamide, N-alkylamino alkyl(alkyl)acrylamide, N-alkylamino alkyl(aryl)acrylamide, N-arylamino alkyl acrylamide, N-arylamino alkyl(alkyl)acrylamide, N-arylamino alkyl(aryl)acrylamide, N,N-di-alkylamino alkyl acrylamide, N,N-di-alkylamino alkyl(alkyl)acrylamide, N,N-di-alkylamino alkyl(aryl)acrylamide, N,N-di-arylamino alkyl acrylamide, N,N-di-arylamino alkyl (alkyl)acrylamide, N,N-di-arylamino alkyl(aryl) acrylamide, and combinations thereof, wherein said alkyl moiety is a radical independently selected from the group consisting of a C1 to C6 saturated alkyl, vinyl, C3 to C6 unsaturated alkylene radical, and combinations thereof; wherein said aryl moiety is a radical independently selected from the group consisting of a benzyl, phenyl, styryl, hydroxyphenyl, alkylbenzyl, alkylphenyl radical, and combinations thereof;

(ii) a second monomer that is acidic and that is capable of forming an anionic charge in the compositions;

(iii) optionally, a third monomer that has an uncharged hydrophilic group; and (iv) optionally, a fourth monomer that is hydrophobic;

wherein said copolymer film exhibits a water contact angle of less than 10 degrees and a thickness of less than about 100 nm on the hard surface.

DETAILED DESCRIPTION OF THE INVENTION

The aqueous cleaning compositions for hard surfaces includes:

(a) a water-soluble or water-dispersible copolymer having:

(i) a first monomer that is capable of forming a cationic charge on protonation selected from the group consisting of an N-alkyl acrylamide, N-alkyl(alkyl)acrylamide, N-aryl acrylamide, N-aryl(alkyl)acrylamide, N-alkyl (aryl)acrylamide, N,N-di-alkyl acrylamide, N,N-di-alkyl(alkyl)acrylamide, N,N-di-alkyl(aryl)acrylamide, N,N-di-aryl acrylamide, N,N-di-aryl(alkyl)acrylamide, N,N-di-aryl(aryl)acrylamide, N-alkylamino alkyl acrylamide, N-alkylamino alkyl(alkyl)acrylamide, N-alkylamino alkyl(aryl)acrylamide, N-arylamino alkyl acrylamide, N-arylamino alkyl(alkyl)acrylamide, N-arylamino alkyl(aryl)acrylamide, N,N-di-alkylamino alkyl acrylamide, N,N-di-alkylamino alkyl(alkyl)acrylamide, N,N-di-alkylamino alkyl(aryl)acrylamide, N,N-di-arylamino alkyl acrylamide, N,N-di-arylamino alkyl (alkyl)acrylamide, N,N-di-arylamino alkyl(aryl) acrylamide, and combinations thereof, wherein said alkyl moiety is a radical independently selected from the group consisting of a C1 to C6 saturated alkyl, vinyl, C3 to C6 unsaturated alkylene radical, and combinations thereof, wherein said aryl moiety is a radical independently selected from the group consisting of a benzyl, phenyl, styryl, hydroxyphenyl, alkylbenzyl, alkylphenyl radical, and combinations thereof;

(ii) a second monomer that is acidic and that is capable of forming an anionic charge in the compositions;

(iii) optionally, a third monomer that has an uncharged hydrophilic group; and (iv) optionally, a fourth monomer that is hydrophobic;

(b) optionally, an organic solvent;

(c) a surfactant; and (d) optionally, an adjuvant;

wherein said copolymer is capable of forming an invisible film on a treated surface exhibiting a water contact angle of less than 10 degrees and a thickness of less than about 100 nm on said treated surface after a cleaning operation.

The level of the first monomer, which is capable of forming a cationic charge on protonation, is typically between 3 and 80 mol % and alternatively from 10 to 60 mol % of the copolymer. The level of second monomer, which is an acidic monomer that is capable of forming an anionic charge in the composition is typically between 3 and 80 mol % and alternatively from 10 to 60 mol % of the copolymer. The level of the third monomer, which has an uncharged hydrophilic group, when present is typically between 3 and 80 mol % and alternatively from 10 to 60 mol % of the copolymer. When present, the level of uncharged hydrophobic monomer is less than about 50 mol % and alternatively less than 10 mol % of the copolymer. The molar ratio of the first monomer to the second monomer typically ranges from 19:1 to 1:10 and alternatively ranges from 9:1 to 1:9. The molar ratio of the first monomer to the third monomer typically ranges from 9:1 to 1:9 and alternatively from 4:1 to 1:4, or yet alternatively from 2:1 to 1:2. The molar ratio of the first monomer to the fourth monomer typically ranges from 9:1 to 1:9 and alternatively from 4:1 to 1:4, or in another embodiment from 2:1 to 1:2.

The average molecular weight of the copolymer typically ranges from about 5,000 to about 10,000,000, with the preferred molecular weight range depending on the polymer composition with the proviso that the molecular weight is selected so that the copolymer is water soluble or water dispersible to at least 0.01% by weight in distilled water at 25° C. In some embodiments, the copolymer comprises 0.1 to 20%, alternatively 0.5 to 10%, and yet alternatively between 0.5 to 1% of the cleaning composition. (All percentages herein are on a weight basis unless noted otherwise.)

Copolymer

Copolymers of the invention require a monomer that is capable of forming a cationic charge on protonation, which includes the capability of forming a partially cationic charge when present in an aqueous solution. It has surprisingly been discovered that the acrylamide nitrogen demonstrates sufficient hydrophilicity in polymer films formed from copolymers containing an acrylamide functional monomer such that behavior is consistent with partial protonation of the nitrogen moiety to either a fully or partially cationic charge. Without being bound by theory, it is believed that such behavior accounts for the copolymers unusual substantivity on surfaces independent of hydrophobic interactions, enabling the inventive copolymer to exhibit rapid and efficient surface substantivity to produce extremely thin and homogenous films on treated surfaces while simultaneously providing the surface with a surprisingly low energy hydrophilic property capable of shedding water and soils.

Suitable first monomers that are capable of forming a cationic charge on protonation in aqueous solutions include monomers selected from N-alkyl acrylamide, N-alkyl(alkyl) acrylamide, N-aryl acrylamide, N-aryl(alkyl)acrylamide, N-alkyl(aryl)acrylamide, N,N-di-alkyl acrylamide, N,N-di-alkyl(alkyl)acrylamide, N,N-di-alkyl(aryl)acrylamide, N,N-di-aryl acrylamide, N,N-di-aryl(alkyl)acrylamide, N,N-di-aryl(aryl)acrylamide, N-alkylamino alkyl acrylamide, N-alkylamino alkyl(alkyl)acrylamide, N-alkylamino alky (aryl)acrylamide, N-arylamino alkyl acrylamide, N-arylamino alkyl(alkyl)acrylamide, N-arylamino alkyl(aryl)acrylamide, N,N-di-alkylamino alkyl acrylamide, N,N-di-alkylamino alkyl(alkyl)acrylamide, N,N-di-alkylamino alkyl (aryl)acrylamide, N,N-di-arylamino alkyl acrylamide, N,N-di-arylamino alkyl(alkyl)acrylamide, N,N-di-arylamino alkyl(aryl)acrylamide, and combinations thereof; wherein the alkyl is a radical independently selected from the group consisting of a C1 to C6 saturated alkyl, vinyl and C3 to C6 unsaturated alkylene radical; and wherein the aryl is a radical independently selected from the group consisting of a benzyl, phenyl, hydroxyphenyl, alkylbenzyl and alkylphenyl radical.

Representative embodiments include a first monomer that is selected from an alkyl acrylamide family group, including but not limited to N-methyl acrylamide, N-methyl methacrylamide, N-methyl ethacrylamide, N-methyl n-propylacrylamide, N-methyl isopropylacrylamide, N-methyl n-butylacrylamide, N-methyl iso-butylacrylamide, N-methyl tert-butylacrylamide, N-methyl pentylacrylamide, N-methyl hexylacrylamide, N-ethyl acrylamide, N-ethyl methacrylamide, N-ethyl ethacrylamide, N-ethyl n-propylacrylamide, N-ethyl isopropylacrylamide, N-ethyl n-butylacrylamide, N-ethyl iso-butylacrylamide, N-ethyl tert-butylacrylamide, N-ethyl pentylacrylamide, N-ethyl hexylacrylamide, N-phenyl acrylamide, N-phenyl methacrylamide, N-phenyl ethacrylamide, N-methyl phenylacrylamide, N,N-di-methyl acrylamide, N,N-di-methyl methacrylamide, N,N-di-methyl ethacrylamide, N,N-di-methyl phenylacrylamide, N,N-di-phenyl acrylamide, N,N-di-phenyl methacrylamide, N,N-di-phenyl ethacrylamide, N,N-di-phenyl butylacrylamide, N-hydroxyphenyl acrylamide, N-hydroxyphenyl methacrylamide, N-hydroxyphenyl ethacrylamide, N-methyl hydroxyphenylacrylamide, N,N-di-methyl acrylamide, N,N-di-methyl methacrylamide, N,N-di-methyl ethacrylamide, N,N-di-methyl hydroxyphenylacryl-amide, N,N-di-hydroxyphenyl acrylamide, N,N-di-hydroxyphenyl methacrylamide, N,N-di-hydroxyphenyl ethacrylamide, N,N-di-hydroxyphenyl butylacrylamide, N-styryl acrylamide, N-styryl methacrylamide, N-styryl ethacrylamide, N-methyl styrylacrylamide, N,N-di-methyl acrylamide, N,N-di-methyl methacrylamide, N,N-di-methyl ethacrylamide, N,N-di-methyl styrylacrylamide, N,N-di-styryl acrylamide, N,N-di-styryl methacrylamide, N,N-di-styryl ethacrylamide, N,N-di-styryl butylacrylamide, N-benzyl acrylamide, N-benzyl methacrylamide, N-benzyl ethacrylamide, N-methyl benzylacrylamide, N,N-di-methyl acrylamide, N,N-di-methyl methacrylamide, N,N-di-methyl ethacrylamide, N,N-di-methyl benzylacrylamide, N,N-di-benzyl acrylamide, N,N-di-benzyl methacrylamide, N,N-di-benzyl ethacrylamide, N,N-di-benzyl butylacrylamide, N,N-di-methyl acrylamide, N,N-di-ethyl acrylamide, N,N-di-n-propyl acrylamide, N,N-di-isopropylacrylamide, N,N-di-n-butyl acrylamide, N,N-di-isobutyl acrylamide, N,N-di-tert-butyl acrylamide, N,N-di-pentyl acrylamide, N,N-di-hexyl acrylamide, N,N-di-methyl methacrylamide, N,N-di-ethyl methacrylamide, N,N-di-n-propyl methacrylamide, N,N-di-isopropyl methacrylamide, N,N-di-n-butyl methacrylamide, N,N-di-isobutyl methacrylamide, N,N-di-tert-butyl methacrylamide, N,N-di-pentyl methacrylamide, N,N-di-hexyl methacrylamide, N,N-di-methyl ethacrylamide, N,N-di-ethyl ethacrylamide, N,N-di-n-propyl ethacrylamide, N,N-di-isopropyl ethacrylamide, N,N-di-n-butyl ethacrylamide, N,N-di-isobutyl ethacrylamide, N,N-di-tert-butyl ethacrylamide, N,N-di-pentyl ethacrylamide, N,N-di-hexyl ethacrylamide, N,N-di-methyl butylacrylamide, N,N-di-ethyl butylacrylamide, N,N-di-n-propyl butylacrylamide, N,N-di-isopropyl butylacrylamide, N,N-di-n-butyl butylacrylamide, N,N-di-isobutyl butylacrylamide, N,N-di-tert-butyl butylacrylamide, N,N-di-pentyl butylacrylamide, N,N-di-hexyl butylacrylamide, N,N-di-methyl propylacrylamide, N,N-di-ethyl propylacrylamide, N,N-di-n-propyl propylacrylamide, N,N-di-isopropyl propylacrylamide, N,N-di-n-butyl propylacrylamide, N,N-di-isobutyl propylacrylamide, N,N-di-tert-butyl propylacrylamide, N,N-di-pentyl propylacrylamide, N,N-di-hexyl propylacrylamide, N,N-di-vinyl acrylamide, and combinations thereof.

Representative embodiments further include a first monomer that is selected from a N-alkylamino alkyl acrylamide or N,N-di-alkylamino alkyl acrylamide family group, including but not limited to N-methylamino methyl acrylamide, N-methylamino methyl methacrylamide, N-methylamino ethyl acrylamide, N-methylamino ethyl methacrylamide, N-methylamino ethyl ethacrylamide, N-ethylamino methyl acrylamide, N-ethylamino methyl methacrylamide, N-ethylamino ethyl acrylamide, N-ethylamino ethyl methacrylamide, N-ethylamino ethyl ethacrylamide, N-propylamino methyl acrylamide, N-propylamino methyl methacrylamide, N-propylamino ethyl acrylamide, N-propylamino ethyl methacrylamide, N-propylamino ethyl ethacrylamide, N-butylamino methyl acrylamide, N-butylamino methyl methacrylamide, N-butylamino ethyl acrylamide, N-butylamino ethyl methacrylamide, N-butylamino ethyl ethacrylamide, N-pentylamino methyl acrylamide, N-pentylamino methyl methacrylamide, N-pentylamino ethyl acrylamide, N-pentylamino ethyl methacrylamide, N-pentylamino ethyl ethacrylamide, N-hexylamino methyl acrylamide, N-hexylamino methyl methacrylamide, N-hexylamino ethyl acrylamide, N-hexylamino ethyl methacrylamide, N-hexylamino ethyl ethacrylamide, N-methylamino ethyl acrylamide, N-methylamino ethyl methacrylamide, N-methylamino propyl acrylamide, N-methylamino propyl methacrylamide, N-methylamino propyl ethacrylamide, N-ethylamino ethyl acrylamide, N-ethylamino ethyl methacrylamide, N-ethylamino propyl acrylamide, N-ethylamino propyl methacrylamide, N-ethylamino propyl ethacrylamide, N-propylamino ethyl acrylamide, N-propylamino ethyl methacrylamide, N-propylamino propyl acrylamide, N-propylamino propyl methacrylamide, N-propylamino propyl ethacrylamide, N-butylamino ethyl acrylamide, N-butylamino ethyl methacrylamide, N-butylamino propyl acrylamide, N-butylamino propyl methacrylamide, N-butylamino propyl ethacrylamide, N-pentylamino ethyl acrylamide, N-pentylamino ethyl methacrylamide, N-pentylamino propyl acrylamide, N-pentylamino propyl methacrylamide, N-pentylamino propyl ethacrylamide, N-hexylamino ethyl acrylamide, N-hexylamino ethyl methacrylamide, N-hexylamino propyl acrylamide, N-hexylamino propyl methacrylamide, N-hexylamino propyl ethacrylamide, N-methylamino ethyl acrylamide, N-methylamino ethyl methacrylamide, N-methylamino butyl acrylamide, N-methylamino butyl methacrylamide, N-methylamino butyl ethacrylamide, N-ethylamino ethyl acrylamide, N-ethylamino ethyl methacrylamide, N-ethylamino butyl acrylamide, N-ethylamino butyl methacrylamide, N-ethylamino butyl ethacrylamide, N-propylamino ethyl acrylamide, N-propylamino ethyl methacrylamide, N-propylamino butyl acrylamide, N-propylamino butyl methacrylamide, N-propylamino butyl ethacrylamide, N-butylamino ethyl acrylamide, N-butylamino ethyl methacrylamide, N-butylamino butyl acrylamide, N-butylamino butyl methacrylamide, N-butylamino butyl ethacrylamide, N-pentylamino ethyl acrylamide, N-pentylamino ethyl methacrylamide, N-pentylamino butyl acrylamide, N-pentylamino butyl methacrylamide, N-pentylamino butyl ethacrylamide, N-hexylamino ethyl acrylamide, N-hexylamino ethyl methacrylamide, N-hexylamino butyl acrylamide, N-hexylamino butyl methacrylamide, N-hexylamino butyl ethacrylamide, N,N-di-methylamino methyl acrylamide, N,N-di-methylamino methyl methacrylamide, N,N-di-methylamino ethyl acrylamide, N,N-di-methylamino ethyl methacrylamide, N,N-di-methylamino ethyl ethacrylamide, N,N-di-ethylamino methyl acrylamide, N,N-di-ethylamino methyl methacrylamide, N,N-di-ethylamino ethyl acrylamide, N,N-di-ethylamino ethyl methacrylamide, N,N-di-ethylamino ethyl ethacrylamide, N,N-di-propylamino methyl acrylamide, N,N-di-propylamino methyl methacrylamide, N,N-di-propylamino ethyl acrylamide, N,N-di-propylamino ethyl methacrylamide, N,N-di-propylamino ethyl ethacrylamide, N,N-di-butylamino methyl acrylamide, N,N-di-butylamino methyl methacrylamide, N,N-di-butylamino ethyl acrylamide, N,N-di-butylamino ethyl methacrylamide, N,N-di-butylamino ethyl ethacrylamide, N,N-di-pentylamino methyl acrylamide, N,N-di-pentylamino methyl methacrylamide, N,N-di-pentylamino ethyl acrylamide, N,N-di-pentylamino ethyl methacrylamide, N,N-di-pentylamino ethyl ethacrylamide, N,N-di-hexylamino methyl acrylamide, N,N-di-hexylamino methyl methacrylamide, N,N-di-hexylamino ethyl acrylamide, N,N-di-hexylamino ethyl methacrylamide, N,N-di-hexylamino ethyl ethacrylamide, N,N-di-methylamino ethyl acrylamide, N,N-di-methylamino ethyl methacrylamide, N,N-di-methylamino propyl acrylamide, N,N-di-methylamino propyl methacrylamide, N,N-di-methylamino propyl ethacrylamide, N,N-di-ethylamino ethyl acrylamide, N,N-di-ethylamino ethyl methacrylamide, N,N-di-ethylamino propyl acrylamide, N,N-di-ethylamino propyl methacrylamide, N,N-di-ethylamino propyl ethacrylamide, N,N-di-propylamino ethyl acrylamide, N,N-di-propylamino ethyl methacrylamide, N,N-di-propylamino propyl acrylamide, N,N-di-propylamino propyl methacrylamide, N,N-di-propylamino propyl ethacrylamide, N,N-di-butylamino ethyl acrylamide, N,N-di-butylamino ethyl methacrylamide, N,N-di-butylamino propyl acrylamide, N,N-di-butylamino propyl methacrylamide, N,N-di-butylamino propyl ethacrylamide, N,N-di-pentylamino ethyl acrylamide, N,N-di-pentylamino ethyl methacrylamide, N,N-di-pentylamino propyl acrylamide, N,N-di-pentylamino propyl methacrylamide, N,N-di-pentylamino propyl ethacrylamide, N,N-di-hexylamino ethyl acrylamide, N,N-di-hexylamino ethyl methacrylamide, N,N-di-hexylamino propyl acrylamide, N,N-di-hexylamino propyl methacrylamide, N,N-di-hexylamino propyl ethacrylamide, N,N-di-methylamino ethyl acrylamide, N,N-di-methylamino ethyl methacrylamide, N,N-di-methylamino butyl acrylamide, N,N-di-methylamino butyl methacrylamide, N,N-di-methylamino butyl ethacrylamide, N,N-di-ethylamino ethyl acrylamide, N,N-di-ethylamino ethyl methacrylamide, N,N-di-ethylamino butyl acrylamide, N,N-di-ethylamino butyl methacrylamide, N,N-di-ethylamino butyl ethacrylamide, N,N-di-propylamino ethyl acrylamide, N,N-di-propylamino ethyl methacrylamide, N,N-di-propylamino butyl acrylamide, N,N-di-propylamino butyl methacrylamide, N,N-di-propylamino butyl ethacrylamide, N,N-di-butylamino ethyl acrylamide, N,N-di-butylamino ethyl methacrylamide, N,N-di-butylamino butyl acrylamide, N,N-di-butylamino butyl methacrylamide, N,N-di-butylamino butyl ethacrylamide, N,N-di-pentylamino ethyl acrylamide, N,N-di-pentylamino ethyl methacrylamide, N,N-di-pentylamino butyl acrylamide, N,N-di-pentylamino butyl methacrylamide, N,N-di-pentylamino butyl ethacrylamide, N,N-di-hexylamino ethyl acrylamide, N,N-di-hexylamino ethyl methacrylamide, N,N-di-hexylamino butyl acrylamide, N,N-di-hexylamino butyl methacrylamide, N,N-di-hexylamino butyl ethacrylamide, N,N-di-phenylamino methyl acrylamide, N,N-di-phenylamino methyl methacrylamide, N,N-di-phenylamino ethyl acrylamide, N,N-di-phenylamino ethyl methacrylamide, N,N-di-phenylamino ethyl ethacrylamide, N,N-di-benzylamino methyl acrylamide, N,N-di-benzylamino methyl methacrylamide, N,N-di-benzylamino ethyl acrylamide, N,N-di-benzylamino ethyl methacrylamide, N,N-di-benzylamino ethyl ethacrylamide, N,N-di-hydroxyphenylamino methyl acrylamide, N,N-di-hydroxyphenylamino methyl methacrylamide, N,N-di-hydroxyphenylamino ethyl acrylamide, N,N-di-hydroxyphenylamino ethyl methacrylamide, N,N-di-hydroxyphenylamino ethyl ethacrylamide, N,N-di-styrylamino methyl acrylamide, N,N-di-styrylamino methyl methacrylamide, N,N-di-styrylamino ethyl acrylamide, N,N-di-styrylamino ethyl methacrylamide, N,N-di-styrylamino ethyl ethacrylamide, N,N-di-vinylamino acrylamide, and combinations thereof.

Monomers that are cationic on protonation typically contain a positive charge over a portion of the pH range of 2-11. Such suitable monomers are also presented in *Water-Soluble Synthetic Polymers: Properties and Behavior*, Volume II, by P. Molyneux, CRC Press, Boca Raton, 1983, ISBN 0-8493-6136. Additional monomers can be found in the *International Cosmetic Ingredient Dictionary,* 5th Edition, edited by J. A. Wenninger and G. N. McEwen, The Cosmetic, Toiletry, and Fragrance Association, Washington D.C., 1993, ISBN 1-882621-06-9. A third source of such monomers can be found in *Encyclopedia of Polymers and Thickeners for Cosmetics*, by R. Y. Lochhead and W. R. Fron, Cosmetics & Toiletries, vol. 108, May 1993, pp 95-135. All three references are incorporated herein in their entirety.

Examples of acidic monomers that are capable of forming an anionic charge in the composition include, but are not limited to, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, and sulfoethyl acrylate. Suitable acidic monomers also include styrenesulfonic acid, 2-methacryloyloxymethane-sulfonic acid, 3-methacryloyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid and vinyl phosphoric acid. Suitable common commercial monomers include acrylic acid, methacrylic acid and maleic acid. The copolymers useful in this invention may contain the above acidic monomers and the alkali metal, alkaline earth metal, and ammonium salts thereof.

Without being bound by theory, it is believed that the combination of both a first monomer capable of forming a cationic charge on protonation in aqueous solutions, yet which appears to retain some hydrophobic properties owing to having either an acrylamide and/or alkylamino acrylamide functionality present on the copolymer backbone even in combination with a second monomer capable of forming an anionic charge in the compositions, provides for a substantive polymer that exhibits the surprising properties of forming a film on a surface that is substantive, yet orients upon absorption to the surface to produce an overall hydrophilic surface modification.

The molar ratio of the first monomer to the second monomer typically ranges from 19:1 to 1:10 and alternatively ranges from 9:1 to 1:9.

The copolymers may further contain additional monomers, selected from an uncharged hydrophilic monomer or an uncharged hydrophobic monomer.

Examples of monomers having an uncharged hydrophilic group include but are not limited to vinyl alcohol, vinyl acetate, vinyl methyl ether, vinyl ethyl ether. Also suitable are hydrophilic esters of monomers, such as hydroxyalkyl acrylate esters, alcohol ethoxylate esters, alkylpolyglycoside esters, and polyethylene glycol esters of acrylic and methacrylic acid, and mixtures thereof.

Examples of uncharged hydrophobic monomers include, but are not limited to, $C_1$-$C_{12}$ alkyl esters of acrylic acid and of methacrylic acid. Example embodiments of suitable uncharged hydrophobic monomers include, but are not limited to, lauryl ester of methacrylic acid, lauryl ester of methyl methacrylic acid, lauryl ester of dimethyl-acrylic acid, ethyl ester of methylacrylic acid and ethyl ester of dimethylacrylic acid.

The molar ratio of the first monomer to the third monomer typically ranges from 9:1 to 1:9 and alternatively from 4:1 to 1:4, or yet alternatively from 2:1 to 1:2. The molar ratio of the first monomer to the fourth monomer typically ranges from 9:1 to 1:9 and alternatively from 4:1 to 1:4, or in another embodiment from 2:1 to 1:2.

The copolymers are formed by copolymerizing the desired monomers. Conventional polymerization techniques can be employed. Illustrative techniques include, for example, solution, suspension, dispersion, or emulsion polymerization. A common commercial method of preparation is by precipitation or inverse suspension polymerization of the copolymer from a polymerization media in which the monomers are dispersed in a suitable solvent. The monomers employed in preparing the copolymer are preferably water soluble and sufficiently soluble in the polymerization media to form a homogeneous solution. They readily undergo polymerization to form polymers which are water-dispersible or water-soluble. Suitable synthetic methods for these copolymers are described, for example, in Kirk-Othmer, *Encyclopedia of Chemical Technology*, Volume 1, Fourth Ed., John Wiley & Sons.

The average molecular weight of the copolymer typically ranges from about 5,000 to about 10,000,000, with the preferred molecular weight range depending on the polymer composition with the proviso that the molecular weight is selected so that the copolymer is water soluble or water dispersible to at least 0.01% by weight in distilled water at 25° C. In some embodiments, the copolymer comprises 0.1 to 20%, alternatively 0.5 to 10%, and yet alternatively between 0.5 to 1% of the cleaning composition.

Aqueous Carrier

The compositions of the present invention may employ an aqueous liquid carrier that includes water and optionally one or more organic solvents. Water typically comprises from about 50% to 100%, or alternatively from about 60% to about 98%, and for typical applications alternatively from about 80% to about 96% of the aqueous carrier, with the optional solvent forming the balance of the composition. Deionized or softened water is generally employed where reduced surface residue is desirable, particularly when treating surfaces whose visual appearance after treatment is at issue, or where no rinsing after treatment is desirable.

In low-surfactant compositions generally for use in no-rinse cleaning, the aqueous carrier typically comprise about 98% to about 99.99%, alternatively from about 99% to about 99.99%, and alternatively for very dilute applications from about 99.5% to about 99.99%, of the compositions.

The solvent is typically used to dissolve various components in the improved cleaning composition so as to form a substantially uniformly dispersed mixture. The solvent can also function as (i) a cleaning agent to loosen and solubilize greasy or oily soils from surfaces, (ii) a residue inhibiting agent to reduce residues left behind on a cleaned surface, (iii) a detergent agent, and/or (iv) a disinfecting, sanitizing, and/or sterilizing agent.

The solvent, when used, can be premixed with the other components of the cleaning composition or be partially or fully added to the improved cleaning composition prior to use. The solvent may be water soluble and/or it is a water dispersible organic solvent. The solvent can be selected to have the desired volatility depending on the cleaning application.

Suitable solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, propylene glycol n-propyl ether, propylene glycol monobutyl ether, propylene glycol t-butyl ether, diethylene glycol monoethyl or monopropyl or monobutyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water soluble solvent when employed.

When water insoluble solvents are mixed with a water soluble solvent for the cleaning composition, the amount of the water insoluble solvent in the cleaning composition is generally less than about 10% typically less than about 5% and more typically less than about 1% of the cleaning composition. As can be appreciated, the cleaning composition can be a non-aqueous cleaner wherein little, if any, water is used. In such formulations, amount of the water insoluble solvent can be greater than about 10%.

Suitable water insoluble solvent includes, but is not limited to, tertiary alcohols, hydrocarbons (e.g. alkanes), pine-oil, terpinoids, turpentine, turpentine derivatives, terpenoid derivatives, terpinolenes, limonenes, pinenes, terpene derivatives, benzyl alcohols, phenols, and their homologues. Certain terpene derivatives that can be used include, but are not limited to, d-limonene, and dipentene. Pyrrolidones include, but are not limited to, N-methyl-2-pyrrolidone, N-octyl-2-pyrrolidone and N-dodecyl-2-pyrrolidone. In one particular formulation of the cleaning composition, the solvents can include, but are not limited to, n-propanol, isopropanol, butanol, ethyleneglycol butylether, diethyleneglycol butylether, propyleneglycol butylether, dipropyleneglycol butylether, and/or hexyl Cellusolve. In another embodiment formulation, the solvent includes isopropanol and/or propyleneglycol butylether.

Typically, the cleaning composition includes at least about 0.5% solvent to avoid solubility problems which can result from the combination of various components of the cleaning composition. The amount of the solvent in the cleaning composition may exceed about 70% when formulated as a concentrate.

Surfactant

The cleaning composition may include an effective amount of surfactant for (i) improving the cleaning performance (e.g., by improving wetting properties), (ii) stabilizing the cleaning composition, and (iii) emulsifying the cleaning components. Conventional anionic, cationic, zwitterionic, and/or amphoteric surfactants can be employed. Suitable surfactants are described in *McCutcheon's Emulsifiers and Detergents* (1997), Kirk-Othmer, Encyclopedia of Chemical Technology, 3rd Ed., Volume 22, pp. 332-432 (Marcel-Dekker, 1983), and *McCutcheon's Soaps and Detergents* (N. Amer. 1984), which are incorporated herein by reference.

Suitable surfactant includes, but is not limited to, glycoside, glycols, ethylene oxide and mixed ethylene oxide/propylene oxide adducts of alkylphenols and alcohols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, sorbitan monooleates, alkanolamides, soaps, alkylbenzene sulfonates, olefin sulfonates, paraffin sulfonates, propionic acid derivatives, alcohol and alcohol ether sulfates, phosphate esters, amines, amine oxides, alkyl sulfates, alkyl ether sulfates, sarcosinates, sulfoacetates, sulfosuccinates, cocoamphocarboxy glycinate, salts of higher acyl esters of isethionic acid, salts of higher acyl derivatives of taurine or methyltaurine, phenol poly ether sulfates, higher acyl derivatives of glycine and methylglycine, alkyl aryl polyether alcohols, salts of higher alkyl substituted imadazolinium dicarboxylic acids, tannics, naphthosulfonates, monochloracetics anthraflavinics, hippurics, anthranilics, naphthoics, phthalics, carboxylic acid salts, acrylic acids, phosphates, alkylamine ethoxylates, ethylenediamine alkoxylates, betaines, sulfobetaines, and imidazolines.

Lauryl sulfate, laurylether sulfate, cocamidopropylbetaine, alkyl polyglycosides, and amine oxides can also be employed as surfactants. The amine oxides can be ethoxylated and/or propoxylated. One specific amine oxide includes, but is not limited to, alkyl di(hydroxy lower alkyl) amine oxides, alkylamidopropyl di(lower alkyl) amine oxides, alkyl di(lower alkyl) amine oxides, and/or alkylmorpholine oxides, wherein the alkyl group has 5-25 carbons and can be branched, unbranched, saturated, and/or unsaturated. Nonlimiting examples of amine oxides include, but are not limited to, lauryl amine oxide sold under the trade name BARLOX® 12 from Lonza.

The alkyl polyglycosides is typically formed by reacting a sugar with a higher alcohol in the presence of an acid catalyst, or by reacting a sugar with a lower alcohol (for example, methanol, ethanol, propanol, butanol) to thereby provide a lower alkyl glycoside, which is then reacted with a higher alcohol. The higher alcohol generally has the formulation $R_1O(R_2O)_XH$, wherein $R_1$ represents a straight or branched alkyl, alkenyl, or alkylphenyl group having from 2 to 30 carbon atoms, $R_2$ represents an alkylene group having from 2 to 20 carbon atoms, and X is a mean value that is 0 to 10. Specific non-limiting examples of the higher alcohol are straight or branched alkanol such as hexanol, heptanol, octanol, nonanol, decanol, dodecanol, tridecanol, tetradecanol, pentadecanol, hexadecanol, heptadecanol, octadecanol, methylpentanol, methylhexanol, methylheptanol, methyloctanol, methyldecanol, methylundecanol, methyltridecanol, methylheptadecanol, ethylhexanol, ethyloctanol, ethyldecanol, ethyldodecanol, 2-heptanol, 2-nonanol, 2-undecanol, 2-tridecanol, 2-pentadecanol, 2-heptadecanol, 2-butyloctanol, 2-hexyloctanol, 2-octyloctanol, 2-hexyldecanol and/or 2-octyldecanol; an alkenol such as hexenol, heptenol, octenol, nonenol, decenol, undecenol, dodecenol, tridecenol, tetradecenol, pentadecenol, hexadecenol, heptadecenol and octadecenol, and alkylphenols such as octylphenol and nonylphenol. These alcohols or alkylphenols may be used either alone or a mixture of two or more of them.

Further, an alkylene oxide adduct of these alcohols or alkylphenols can be used. The sugar used to form the alkyl glycoside includes, but is not limited to, monosaccharides, oligosaccharides, and polysaccharides. Nonlimiting examples of the monosaccharides include aldoses such as, but not limited to, allose, altrose, glucose, mannose, gulose, idose, galactose, talose, ribose, arabinose, xylose, and lyxose. Nonlimiting examples of the oligosaccharides include maltose, lactose, sucrose and maltotriose. Nonlimiting examples of the polysaccharides include hemicellulose, insulin, dextrin, dextran, xylan, starch and/or hydrolyzed starch. Specific alkyl glycosides that can be used are represented by the following formula: $D_1O(D_2O)_XH_Y$ wherein $D_1$ is an alkyl, alkenyl, or alkylphenyl group having from 6 to 30 carbon atoms, $D_2$ is an alkylene group having from 2 to 20 carbon atoms, H is a residual group originating from a reducing sugar having 2 or 10 carbon atoms, X is a mean value that is 0 to 10, and Y is a mean value that is 1 to 10. Nonlimiting examples of alkyl polyglycosides include, but are not limited to, APG series alkyl polyglycosides from Cognis.

Surfactants may also include ethoxylated alcohols having an alkyl group typically with 6-22 carbons; the alkyl group is generally linear but could be branched. Furthermore, the carbon groups can be saturated or unsaturated. Suitable ethoxylated alcohols include the SURFONIC® L series surfactants by Huntsman. Fluorosurfactants can also be used as the surfactant. A suitable fluorosurfactant is an ethoxylated nonionic fluorosurfactant. Suitable ethoxylated nonionic fluorosurfactants include the ZONYL® surfactants by DuPont. Also suitable are the low environmental impact PolyFox® polymeric oxetane fluorosurfactants available from Omnova.

In one embodiment, nonionic surfactants provide good formulation versatility in combination with the copolymers, particularly in cleaning compositions where the level of surfactant employed is approximately equivalent or exceeds the weight % level of the copolymer. In other embodiments, anionic and cationic surfactants are suitably employed in combination with the copolymers. Preferred surfactants are those which leave low residues on a treated surface at the level of use in the cleaning compositions, particularly in applications where no rinsing operation of the composition from the surface is done following a cleaning operation.

Typically the surfactant is partially or fully soluble in water. When employed, the surfactant comprises at least about 0.001% and typically 0.01-10% of the cleaning composition. The amount of surfactant may exceed 10% when the cleaning composition is formulated in concentrate. In a typical embodiment for general cleaning and surface treatment applications, the surfactant content may be about 0.1-2% of the composition.

An effective amount of surfactant is the level of surfactant sufficient to aid in the uniform wetting and spreading of the aqueous cleaning compositions containing the copolymer to enable complete coverage of the treated surface with the composition prior to removal, rinsing or drying in order to leave a thin protective copolymer film behind on the surface. Higher levels are optional to provide additional benefits, including cleaning, soil and residue removal and thickening if desired.

Antimicrobial Agent

An antimicrobial agent can also be included in the cleaning composition. Non-limiting examples of useful quaternary compounds that function as antimicrobial agents include benzalkonium chlorides and/or substituted benzalkonium chlorides, di($C_6$-$C_{14}$)alkyl di short chain ($C_{1-4}$ alkyl and/or hydroxyalkyl) quaternary ammonium salts, N-(3-chloroallyl) hexaminium chlorides, benzethonium chloride, methylbenze-thonium chloride, and cetylpyridinium chloride. The quaternary compounds useful as cationic antimicrobial actives and may be selected from the group consisting of di-alkyldimethyl ammonium chlorides, alkyl dimethylbenzylammonium chlorides, di-alkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-4-chlorophenyl biguanide) and its salts are especially suitable. Typical concentrations for biocidal effectiveness of these quaternary compounds, especially in the low-surfactant compositions embodied herein, range from about 0.001% to about 0.8% or alternatively from about 0.005% to about 0.3% of the usage composition. The weight percentage ranges for the biguanide and/or quat compounds in the cleaning composition is selected to disinfect, sanitize, and/or sterilize most common household and industrial surfaces.

Non-quaternary biocides are also useful in the present compositions. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, quaternary phosphate compounds, and phenolics Builder/Buffer The cleaning composition may include a builder detergent which increase the effectiveness of the surfactant. The builder detergent can also function as a softener and/or a sequestering and buffering agent in the cleaning composition. A variety of builder detergents can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builder detergents can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Suitable buffering agents for compositions of this invention are nitrogen-containing materials. Some examples are amino acids such as lysine or lower alcohol amines like mono-, di-, and tri-ethanolamine. Other suitable nitrogen-containing buffering agents are Tri(hydroxymethyl) amino methane $(HOCH_2)_3CNH_3$ (TRIS), 2-amino-2-ethyl-1, 3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris(hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see McCutcheon's *Emulsifiers and Detergents*, North American Edition, 1997, McCutcheon Division, MC Publishing Company Kirk and WO 95/07971 both of which are incorporated herein by reference.

When employed, the builder detergent comprises at least about 0.001% and typically about 0.01-5% of the cleaning composition. The amount of the builder detergent may exceed about 5% when the cleaning composition is formulated as a concentrate. Alternatively, the builder detergent content is about 0.01-2%.

Additional Adjuvants

The cleaning composition may includes additional adjuncts. The adjuncts include, but are not limited to, fragrances or perfumes, waxes, dyes and/or colorants, solubilizing materials, stabilizers, thickeners, defoamers, hydrotropes, lotions and/or mineral oils, enzymes, bleaching agents, cloud point modifiers, preservatives, and other polymers. The waxes, when used, include, but are not limited to, carnauba, beeswax, spermacet, candelilla, paraffin, lanolin, shellac, esparto, ouricuri, polyethylene wax, chlorinated naphthalene wax, petrolatum, microcrystalline wax, ceresine wax, ozokerite wax, and/or rezowax. The solubilizing materials, when used, include, but are not limited to, hydrotropes (e.g. water soluble salts of low molecular weight organic acids such as the sodium and/or potassium salts of xylene sulfonic acid). The acids, when used, include, but are not limited to, organic hydroxy acids, citric acids, keto acid, and the like. Thickeners, when used, include, but are not limited to, polyacrylic acid, xanthan gum, calcium carbonate, aluminum oxide, alginates, guar gum, methyl, ethyl, clays, and/or propylhydroxycelluloses. Defoamers, when used, include, but are not limited to, silicones, aminosilicones, silicone blends, and/or silicone/hydrocarbon blends. Lotions, when used, include, but are not limited to, achlorophene and/or lanolin. Enzymes, when used, include, but are not limited to, lipases and proteases, and/or hydrotropes such as xylene sulfonates and/or toluene sulfonates. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard® and/or Glydant®) and/or short chain alcohols (e.g. ethanol and/or IPA).

The mildewstat or bacteriostat includes, but is not limited to, mildewstats (including non-isothiazolone compounds) include Kathon® GC, a 5-chloro-2-methyl-4-isothiazolin-3-one, KATHON ICP®, a 2-methyl-4-isothiazolin-3-one, and a blend thereof, and KATHON 886®, a 5-chloro-2-methyl-4-isothiazolin-3-one, all available from Rohm and Haas Company; BRONOPOL®, a 2-bromo-2-nitropropane 1,3 diol, from Boots Company Ltd., PROXEL CRL®, a propyl-p-hydroxybenzoate, from ICI PLC; NIPASOL® M, an o-phenyl-phenol, $Na^+$ salt, from Nipa Laboratories Ltd., DOWICIDE® A, a 1,2-Benzoisothiazolin-3-one, from Dow Chemical Co., and IRGASAN® DP 200, a 2,4,4'-trichloro-2-hydroxydiphenylether, from Ciba-Geigy A. G.

Absorbent Materials

The cleaning composition of the present invention can be used independently from or in conjunction with an absorbent and/or adsorbent material. For instance, the cleaning composition can be formulated to be used in conjunction with a cleaning wipe, sponge (cellulose, synthetic, etc.), paper towel, napkin, cloth, towel, rag, mop head, squeegee, and/or other cleaning device that includes an absorbent and/or adsorbent material.

The cleaning wipe can be made of nonwoven material such as nonwoven, fibrous sheet materials or meltblown, coform, air-laid, spun bond, wet laid, bonded-carded web materials, and/or hydroentangled (also known as spunlaced) materials. The cleaning wipe can also be made of woven materials such as cotton fibers, cotton/nylon blends and/or other textiles. The cleaning wipe can also include wood pulp, a blend of wood pulp, and/or synthetic fibers, e.g., polyester, rayon, nylon, polypropylene, polyethylene, and/or cellulose polymers.

The absorbent material can be constructed as part of a single or multiple layer cleaning pad attached in either the wet or dry state to the end of a mop. The cleaning pads will generally have an absorbent capacity, when measured under a confining pressure of at least 0.09 p. s. i. after 20 minutes, of at least about 1 g deionized water per g of the cleaning pad, and most suitably of at least about 10 g deionized water per g of the cleaning pad.

When the cleaning formulation is incorporated in an absorbent material, the cleaning composition may include an effective amount of release agent to increase the amount of polymer released from the cleaning wipe onto a surface. The release agent may be an ionic species designed to compete with the polymer for sites on the cleaning wipe thereby causing increased polymer release from the cleaning wipe during use of the cleaning wipe. The release agent may include a salt. A variety of different salts can be used such as, but not limited to, monovalent salts, divalent salts, organic salts, and the like. In one embodiment, the effective ionic strength of the release agent in the cleaning composition is at least about $5\times10^{-3}$ mol/l.

The following examples illustrate the cleaning compositions of the invention. The examples are for illustrative purposes only and are not meant to limit the scope of the invention in any way.

EXAMPLES

Various formulations of the inventive cleaning composition were prepared and tested with respect to a number of characteristics, including the following: (i) water contact angle, (ii) resistance of surface modification to water treatment, (iii) film thickness, (iv) soil build-up prevention and (v) soil cleaning performance.

Water Contact Angle

It is desirable that treated surfaces be modified with respect to water based soils. The contact angle (θ) of a water droplet on a surface enables the degree of hydrophilicity/hydrophobicity to be qualitatively compared, with lower contact angles representative of more hydrophilic surfaces. Small water contact angles mean that the water drops will spread readily on the surface, giving a thin film that readily drains from the surface. The contact angle of water on glass and enamel (i.e., the vitreous protective coating on appliances) surfaces that were treated with the cleaning formulations is a direct measure of the modification of the surface energy. The adsorption of the copolymers, even at thicknesses less than monolayer, decreases the contact angle of water, i.e., the wetting of the surface by water alone is drastically improved. This benefit is evident even after rinsing of the surfaces with water, because of the thermodynamically favored adsorption of the polymers.

Drops of the same volume of water were placed on multiple spots of enamel coupons. The contact angles, in degrees, were measured manually with a Rame-Hart Goniometer, after cleaning the coupon with the formulation, and after rinsing the coupon with 10 sprays of tap water delivered from the same trigger sprayer. The inventive cleaning composition, even after water sprays, gives a water contact angle less than about 10 degrees and very good spreading of the water across the treated surface.

The inventive compositions also provide lower water contact angles even in the presence of hydrophobic soap scum soils. Glossy black tile coupons (4"×4") were pretreated with cleaning formulations by spraying 4 sprays of the product, allowing to sit 3 minutes, followed by 2 sprays rinsing with 300 ppm 3:1 Ca/Mg hard water and allowed to dry. The pretreatment was repeated a second time prior to soiling. Once pretreated, the coupons were then soiled with 4 sprays of a 300 ppm 3:1 mixture of soluble Ca/Mg salts as a simulated hard water rinse followed by 2 sprays of 0.05% soap scum/sebum oil solution, and allowed to dry vertically. The soiling was repeated ten times. The water contact angles were measured as above and are shown in Table 1. The results show that the clean formulation with polymer gives a relatively hydrophilic surface with water spreading, while the surfaces treated without polymer or with a commercial formulation have every hydrophobic surfaces that attract soils.

The cleaning formulation comprised: sulfamic acid 3.5%, glycolic acid 1.5%, Dowfax® 2A1 (anionic) 1.25%, dipropylenegylcol n-butylether 2.5%, propyleneglycol n-propylether 1.5%, alkylpolyglycoside 0.5%, and sufficient potassium hydroxide (KOH) to adjust to pH 2, fragrance, and a copolymer of N,N-dimethylacrylamide and acrylic acid at 0.1% in the composition, balance being deionized water.

TABLE 1

| Composition | Water Contact Angle (Θ) (degrees) after 10 cycles of soap scum treatment |
|---|---|
| Cleaning formulation (no polymer) | 46 |
| Cleaning formulation (polymer) | 29 |
| Commercial cleaning formulation | 48 |

Resistance of Surface Modification to Water Treatment

The inventive copolymers and formulations are particularly useful because of their continued surface modification properties after extended contact with water. This attribute can be measured by the copolymer's resistance to desorption in the presence of water. The ability of the copolymers to remain on a surface, even after repeated exposure of the surface to water was assessed with Fourier Transform Infrared (FT-IR).

FT-IR spectroscopic analysis of hard surfaces can be used successfully to monitor the adsorption and desorption of surfactants and copolymers.

One FT-IR technique is to employ an optical accessory that utilizes the principle of attenuated total reflectance (ATR). In ATR experiments, the infrared radiation is transmitted through an internal reflection element (IRE). Any material that is in intimate contact with the IRE will be able to interact with the infrared radiation and generates an infrared spectrum of the material. The amount of absorbance of the infrared radiation, and hence the intensity of the absorption bands that appear in the spectrum, are directly proportional to the amount of an infrared absorbing material and the pathlength of the infrared radiation through the sample. The relative amounts of surfactant and copolymer that adsorb onto an IRE subjected to various treatments with the inventive cleaning formulations were monitored using FT-IR with ATR optical accessories from Harrick Scientific (Ossining, N.Y.). The IREs were made from germanium, which is an infrared transparent material that, when clean, has a "moderate" surface energy that is similar to many common household surfaces, such as glass, porcelain, ceramic tile, steel, and aluminum. The analysis of the very small amounts of copolymer adsorbed on the surface of the IRE is routine and the relative intensities of the infrared absorption bands in the spectra can be used to distinguish the presence of a monolayer, and even a patchy, partial monolayer of a copolymer from a layer that is many thousands of molecules thick. FT-IR spectroscopy is described in *Fourier Transform Infrared Spectrometry*, by P. R. Griffiths. ATR optical accessories are described in *Internal Reflection Spectroscopy*, By N. J. Harrick, Interscience Publishers, 1967, and *Internal Reflection Spectroscopy Review and Supplement*, by F. M. Mirabella Jr., N. J. Harrick, Editor, Harrick Scientific Corporation, 88 Broadway, Box 1288, Ossining, N.Y. 10562.

A known amount of copolymer solution or cleaning formulation containing a known amount of copolymer was applied to a germanium IRE (total surface area exposed to product=3.75 $cm^2$) and allowed to dry. The IRE was then immersed in deionized water for different lengths of time to simulate exposure of a household surface such as a shower to typical consumer use. After immersion in water, the IRE was dried and the spectrum of the residue still adsorbed on it was recorded. A visual inspection of the IRE, which appears smooth and mirror-like, was done after each water exposure to determine if a film or residue could be detected.

Absorbance measurements confirmed the presence of a polymer film owing to measurable absorbance intensity at 1482 $cm^{-1}$, even though the presence of a film could not be ascertained by appearance, being invisible to the eye.

Film Thickness

There are several possible approaches to changing the surface energy in order to deliver a "next time easier cleaning" benefit. One approach is the application of a macroscopic film (visible to the human eye) to the surface that gradually dissolves upon exposure to water or aqueous cleaning solutions, thereby carrying dirt away. One disadvantage of this approach is the "unevenness" of the film which is caused by variation in consumer cleaning habits. The clarity and evenness of a film deposited on, for example, glass shower doors, or reflective metal stovetops, should be very good but this is very difficult to achieve in practice with a macroscopic film.

A more desirable way to generate an easier next cleaning benefit is through the delivery of a molecule or mixture of molecules as achieved in the instant invention by employing a copolymeric material in a cleaning formulation that enables absorbtion of beneficial copolymers onto a treated surface, at approximately a monolayer level of coverage. This layer, even if it is several molecules thick, is not visible to the eye, and hence does not significantly change the appearance of the surface. Proper selection of copolymer and cleaning composition components allows the adsorption of the copolymer on a given substrate to be controlled spontaneously and reproducibly by thermodynamics rather than by the method of applying the composition.

FT-IR was used to measure the amount of inventive copolymer that adsorbed onto a Ge IRE from aqueous solutions containing various amounts of the copolymer. There was no drying step in these experiments. The IRE was covered by a solution containing the copolymer for 5 minutes. After this step, the copolymer solution was removed and rinsed three times by applying deionized water and quickly removing it.

The total exposure time of the adsorbed copolymer layer to the rinse water was less than 1 minute in all cases, in an attempt to minimize the amount of desorption that occurred. The concentration of the copolymer in the solutions was varied from 0.125% to 2.5%. A calibration curve was created to correlate film thickness to absorbance intensity. The results in Table 2 show that significant adsorption occurs rapidly, even at the lowest concentration, which is due to the thermodynamically favored adsorption of the polymer on the surface. The FT-IR spectra of all of the layers exhibited all the major absorption bands due to the copolymer.

TABLE 2

| Polymer[1] concentration, weight % | Absorbance intensity @ 1495 $cm^{-1}$ | Polymer layer thickness, nanometers (nm) |
|---|---|---|
| 0.125 | 0.000231 | 0.18 |
| 0.125 | 0.000217 | 0.16 |
| 0.250 | 0.000403 | 0.35 |
| 0.250 | 0.000413 | 0.36 |
| 2.50 | 0.000638 | 0.53 |
| 2.50 | 0.000578 | 0.48 |

[1]Copolymer of N,N-dimethylacrylamide and acrylic acid (327,000 MW)

Illustrative Formulations

The following are examples of the inventive composition as formulated for specific applications. These examples are for illustrative purposes only and are not meant to limit the scope of the invention in any way.

TABLE 3

Glass Cleaner

| | Examples | |
|---|---|---|
| | 1 | 2 |
| Isopropanol | 3 | 1 |
| Propyleneglycol n-butyl ether | 1 | 1 |
| Ammonia | 0.3 | |
| Sodium lauryl sulfate | 0.5 | |
| Alkyl polyglucoside | | 0.5 |
| Ethylene diamine tetraacetic acid sodium salt | 0.3 | |
| Monoethanolamine | | 0.3 |
| Polymer A[1] | 0.1 | |
| Polymer B[2] | | 0.15 |

[1]Copolymer of acrylamide and acrylic acid (9:1 ratio).
[2]Copolymer of N, N-dimethylacrylamide and acrylamidopropenylmethylene sulfonic acid (19:1 ratio).

TABLE 4

All Purpose Cleaner

| | Examples | | |
|---|---|---|---|
| | 3 | 4 | 5 |
| Propyleneglycol n-butyl ether | 2.0 | 1.0 | |
| Dipropyleneglycol n-butyl ether | | 1.0 | 1.0 |
| Dimethyllauryl amine oxide | 0.5 | | |
| Alkyl polyglucoside | | 0.5 | |
| C 12-13 alcohol 7-ethoxylate | | | 0.5 |
| Monoethanolamine | 0.3 | | 0.3 |
| Sodium hydroxide | | 0.2 | |
| Dimethyldioctylammonium chloride | | 0.1 | 0.1 |
| Polymer C[1] | 0.1 | | |

TABLE 4-continued

All Purpose Cleaner

| | Examples | | |
|---|---|---|---|
| | 3 | 4 | 5 |
| Polymer D[2] | | 0.1 | |
| Polymer E[3] | | | 0.1 |

[1]Copolymer of N,N-di-isopropyl acrylamide and acrylamide methyl propanesulfonic acid (4:1 ratio).
[2]Copolymer of N,N-di-isopropyl acrylamide and acrylamide methyl propanesulfonic acid (1:4 ratio).
[3]Copolymer of N,N-di-isopropyl acrylamide and acrylamide methyl propanesulfonic acid (1:1 ratio).

TABLE 5

Dilutable Cleaner

| | Examples | |
|---|---|---|
| | 6 | 7 |
| C12-13 alcohol 7-ethoxylate | 10 | 5 |
| C12-13 alcohol 3-ethoxylate | 2 | |
| Pine oil | | 10 |
| Monoethanolamine | 3 | 3 |
| Polymer F[1] | 0.1 | |
| Polymer G[2] | | 0.4 |

[1]Terpolymer of acrylamide, acrylic acid, ethylacrylate (10:3:1 ratio).
[2]Terpolymer of N,N-dimethyl methacrylamide, acrylic acid, and vinylacetate (10:1:2 ratio).

TABLE 6

Basic Bathroom Cleaner

| | Examples | |
|---|---|---|
| | 8 | 9 |
| Propyleneglycol n-propyl ether | 2 | 4 |
| Dimethyllauryl amine oxide | 1 | 1 |
| Monoethanolamine | 0.5 | 0.5 |
| Potassium hydroxide | 0.2 | 0.2 |
| Polymer H[1] | 0.01 | |
| Polymer I[2] | | 5.0 |

[1]Copolymer of N, N-dimethylacrylamide and styrenesulfonic acid (19:1 ratio).
[2]Terpolymer of dimethylamino propyl methacrylamide, acrylic acid, and ethylacrylate (1:2:2 ratio).

TABLE 7

Acidic Bathroom Cleaner

| | Examples | |
|---|---|---|
| | 10 | 11 |
| Diethyleneglycol butylether | 2 | |
| Isopropanol | | 3 |
| C12-13 alcohol 7-ethoxylate | 2 | |
| Dowfax ®2A1 | | 1 |
| Sulfamic acid | 2 | 1 |
| Citric acid | 3 | 2 |
| Polymer J[1] | 1 | |
| Polymer K[2] | | 0.3 |

[1]Copolymer of N, N-dimethylacrylamide and lauryl-5-ethoxyacrylate (1:1 ratio).
[2]Copolymer of acrylamide and methacrylic acid (2:3 ratio).

TABLE 8

No Rinse Shower Cleaner

| | Examples | |
|---|---|---|
| | 12 | 13 |
| Isopropanol | 2 | 3 |
| Alkyl polyglucoside | 0.1 | 0.5 |
| Ethylenediaminetetraacetic acid diammonium salt | 0.5 | |
| Ethylenediaminetetraacetic acid sodium salt | | 1 |
| Dimethyldioctylammonium chloride | 0.2 | |
| Polymer L[1] | 0.05 | |
| Polymer M[2] | | 0.15 |

[1]Copolymer of N, N-dimethylacrylamide and PEG400-acrylate (1:1 ratio).
[2]Copolymer of N-[2-(4-hydroxyphenyl)ethyl]acrylamide and maleic anhydride (1:6 ratio).

TABLE 9

Cleaning or Disinfecting Wipe

| | Examples | |
|---|---|---|
| Solution on polypropylene wipe | 14 | 15 |
| Isopropanol | 3 | 3 |
| C12-13 alcohol 7-ethoxylate | 0.5 | 0.5 |
| Monoethanolamine | 0.2 | |
| Citric acid | | 2 |
| Dimethyldioctylammonium chloride | 0.1 | 0.1 |
| Polymer N[1] | 0.2 | |
| Polymer O[2] | | 0.2 |

[1]Copolymer of N,N-dimethyl methyl methacrylamide and acrylamide vinylsulfonic acid (1:4 ratio).
[2]Copolymer of diethylamino propyl methacrylamide and acrylamide methyl propanesulfonic acid (1:1 ratio).

PERFORMANCE EXAMPLES

Cleaning Performance on Bathroom Soil Build-Up

An acidic bathroom cleaner of the invention was prepared with various copolymers and tested against a cleaner with no copolymers and a commercial bathroom cleaner. Specifically, different amounts of copolymers were added to the base formulation to form the inventive compositions tested. A clean black tile was sprayed with two sprays of product followed in three minutes by four sprays of hard water (300 ppm, Ca:Mg salts in a 3:1 weight % ratio). The tile was allowed to dry and the above product application cycle was repeated. To the dry tile, a simulated use condition treatment of four sprays of hard water followed by two sprays of 0.05% soap/sebum solution was applied and allowed to dry. This use condition treatment was repeated 10 times and the tile was graded for collection of soap/sebum soil on the tile. The results in Table 10 show that the inventive compositions were much better in preventing bathroom soil from adhering to tiles as compared to formulations without the inventive copolymer compositions.

| Base Formulation | |
|---|---|
| DI Water | Q.S. |
| Sulfamic Acid | 3.50% |
| Glycolic Acid | 1.50% |
| Dowfax ® 2A1 | 1.25% |
| Glucopon ® 325 | 0.50% |

-continued

| Base Formulation | |
|---|---|
| Dipropylene glycol n-butyl ether | 2.50% |
| Propylene glycol-n-propylether | 1.50% |
| KOH | 2.00% |
| Polymer | Per Table 10 |

TABLE 10

Monomer ratio

| Polymer Concentration | N,N-DMA[1] | AA[2] | AMPS[3] | M. W.[4] | Score[5] |
|---|---|---|---|---|---|
| 0.50% | 90 | 8 | 2 | 118,000 | 3.70 |
| 0.50% | 90 | 8 | Hydrophobe | | 6.03 |
| 0.50% | 90 | 8 | Hydrophobe | | 6.03 |
| 0.50% | 80% | | 20% | 220,000 | 3.23 |
| 0.50% (Homopolymer) | Branched acrylamide | | | 100,000 | 7.03 |
| 0.50% (Homopolymer) | Branched acrylamide | | | 150,000 | 5.93 |
| 0.50% (Homopolymer) | Branched acrylamide | | | 200,000 | 6.27 |
| No Polymer | | | | | 8.36 |
| Lysol BT&T | | | | | 8.23 |
| Untreated | | | | | 8.10 |

[1]N,N-dimethylacrylamide.
[2]Acrylic acid.
[3]Acrylamidopropenylmethylene sulfonic acid.
[4]Average molecular weight of copolymer.
[5]Average score of visual judging with 1 = "Clean Tile" and 10 = "Dirty Tile".

Cleaning Performance on Baked-On Kitchen Grease Build-Up

Table 11 shows the effect of adding a copolymer of the present invention to a cleaner composition ("Inventive Composition") for use as a pretreatment. The cleaning formula was added as a pretreatment by wiping the tile with a damp sponge containing the cleaning formula. The tile was allowed to dry and then kitchen grease was baked onto the tile. The tile was then cleaned for 30 cycles with a damp sponge and evaluated for relative soil removal. The soil removal was measured by the increased reflection of the cleaned tile. The results show the Inventive Composition provided 30% greater kitchen grease removal than water and 18% greater kitchen grease removal than the Comparative Formula.

TABLE 11

| | Water | Comparative Formula | Inventive Composition |
|---|---|---|---|
| Berol ® 226 | | 1.00% | 1.00% |
| Dowanol ® EB | | 3.00 | 3.00 |
| Lonzabac ® MB50 | | 0.30 | 0.30 |
| $K_4EDTA$ | | 0.44 | 0.44 |
| MEA | | 0.50 | 0.50 |
| Colorant | | 0.001 | 0.001 |
| Polymer[1] | | | 0.1 |
| Balance Water | 100% | q. s. | q. s. |
| Soil Removal | 1 | 1.1 | 1.3 |

[1]Copolymer of N, N-dimethylacrylamide and lauryl-5-ethoxyacrylate (1:1 ratio).

The foregoing has described the principles, embodiments, and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of the present invention as defined by the following claims.

What is claimed is:

1. An aqueous cleaning composition for hard surfaces that comprises:

(a) a water-soluble or water-dispersible copolymer having:

(i) a first monomer that is capable of forming a cationic charge on protonation selected from the group consisting of N-propylamino propyl methacrylamide, N-propylamino propyl ethacrylamide, N-propylamino propyl acrylamide, N-propylamino methyl methacrylamide, N-propylamino methyl acrylamide, N-propylamino ethyl methacrylamide, N-propylamino ethyl ethacrylamide, N-propylamino ethyl acrylamide, N-propylamino butyl methacrylamide, N-propylamino butyl ethacrylamide, N-propylamino butyl acrylamide, N-pentylamino propyl methacrylamide, N-pentylamino propyl ethacrylamide, N-pentylamino propyl acrylamide, N-pentylamino methyl methacrylamide, N-pentylamino methyl acrylamide, N-pentylamino ethyl methacrylamide, N-pentylamino ethyl ethacrylamide, N-pentylamino ethyl acrylamide, N-pentylamino butyl methacrylamide, N-pentylamino butyl ethacrylamide, N-pentylamino butyl acrylamide, N-methylamino propyl methacrylamide, N-methylamino propyl ethacrylamide, N-methylamino propyl acrylamide, N-methylamino methyl methacrylamide, N-methylamino methyl acrylamide, N-methylamino ethyl methacrylamide, N-methylamino ethyl ethacrylamide, N-methylamino ethyl acrylamide, N-methylamino butyl methacrylamide, N-methylamino butyl ethacrylamide, N-methylamino butyl acrylamide, N-hexylamino propyl methacrylamide, N-hexylamino propyl ethacrylamide, N-hexylamino propyl acrylamide, N-hexylamino methyl methacrylamide, N-hexylamino methyl acrylamide, N-hexylamino ethyl methacrylamide, N-hexylamino ethyl ethacrylamide, N-hexylamino ethyl acrylamide, N-hexylamino butyl methacrylamide, N-hexylamino butyl ethacrylamide, N-hexylamino butyl acrylamide, N-ethylamino propyl methacrylamide, N-ethylamino propyl ethacrylamide, N-ethylamino propyl acrylamide, N-ethylamino methyl methacrylamide, N-ethylamino methyl acrylamide, N-ethylamino ethyl methacrylamide, N-ethylamino ethyl ethacrylamide, N-ethylamino ethyl acrylamide, N-ethylamino butyl methacrylamide, N-ethylamino butyl ethacrylamide, N-ethylamino butyl acrylamide, N-butylamino propyl methacrylamide, N-butylamino propyl ethacrylamide, N-butylamino propyl acrylamide, N-butylamino methyl methacrylamide, N-butylamino methyl acrylamide, N-butylamino ethyl methacrylamide, N-butylamino ethyl ethacrylamide, N-butylamino ethyl acrylamide, N-butylamino butyl methacrylamide, N-butylamino butyl ethacrylamide, N-butylamino butyl acrylamide, N,N-di-styrylamino methyl methacrylamide, N,N-di-styrylamino methyl acrylamide, N,N-di-styrylamino ethyl methacrylamide, N,N-di-styrylamino ethyl ethacrylamide, N,N-di-styrylamino ethyl acrylamide, N,N-di propylamino propyl methacrylamide, N,N-di-propylamino propyl ethacrylamide, N,N-di-propylamino propyl acrylamide, N,N-di-propylamino methyl methacrylamide, N,N-di-propylamino methyl acrylamide, N,N-di-propylamino ethyl methacrylamide, N,N-di-propylamino ethyl ethacrylamide, N,N-di-propylamino ethyl acrylamide, N,N-di-propylamino butyl methacrylamide, N,N-di-propylamino butyl ethacrylamide, N,N-di-propylamino butyl acrylamide, N,N-diphenylamino methyl methacrylamide, N,N-diphenylamino methyl acrylamide, N,N-diphenylamino ethyl methacrylamide, N,N-diphenylamino ethyl ethacrylamide, N,N-diphenylamino ethyl acrylamide, N,N-di-pentylamino propyl methacrylamide, N,N-di-pentylamino propyl ethacrylamide, N,N-di-pentylamino propyl acrylamide, N,N-di-pentylamino methyl methacrylamide, N,N-di-pentylamino methyl acrylamide, N,N-di-pentylamino ethyl methacrylamide, N,N-di-pentylamino ethyl ethacrylamide, N,N-di-pentylamino ethyl acrylamide, N,N-di-pentylamino butyl methacrylamide, N,N-di-pentylamino butyl ethacrylamide, N,N-di-pentylamino butyl acrylamide, N,N-di-methylamino propyl ethacrylamide, N,N-di-methylamino methyl methacrylamide, N,N-di-methylamino methyl acrylamide, N,N-di-methyl-amino ethyl ethacrylamide, N,N-di-methylamino butyl methacrylamide, N,N-di-methylamino butyl ethacrylamide, N,N-di-methylamino butyl acrylamide, N,N-di-hydroxyphenylamino methyl methacrylamide, N,N-di-hydroxyphenylamino methyl acrylamide, N,N-di-hydroxyphenylamino ethyl methacrylamide, N,N-di-hydroxyphenylamino ethyl ethacrylamide, N,N-di-hydroxyphenylamino ethyl acrylamide, N,N-di-hexylamino propyl methacrylamide, N,N-di-hexylamino propyl ethacrylamide, N,N-di-hexylamino propyl acrylamide, N,N-di-hexylamino methyl methacry-lamide, N,N-di-hexylamino methyl acrylamide, N,N-di-hexylamino ethyl methacrylamide, N,N-di-hexylamino ethyl ethacrylamide, N,N-di-hexylamino ethyl acrylamide, N,N-di-hexylamino butyl methacrylamide, N,N-di-hexylamino butyl ethacrylamide, N,N-di-hexylamino butyl acrylamide, N,N-di-ethylamino propyl methacrylamide, N,N-di-ethylamino propyl ethacrylamide, N,N-di-ethylamino propyl acrylamide, N,N-di-ethylamino methyl methacrylamide, N,N-di-ethylamino methyl acrylamide, N,N-di-ethylamino ethyl methacrylamide, N,N-di-ethylamino ethyl ethacrylamide, N,N-di-ethylamino ethyl acrylamide, N,N-di-ethylamino butyl methacrylamide, N,N-di-ethylamino butyl ethacrylamide, N,N-di-ethylamino butyl acrylamide, N,N-di-butylamino propyl methacrylamide, N,N-di-butylamino propyl ethacrylamide, N,N-di-butylamino propyl acrylamide, N,N-di-butylamino methyl methacrylamide, N,N-di-butylamino methyl acrylamide, N,N-di-butylamino ethyl methacrylamide, N,N-di-butylamino ethyl ethacrylamide, N,N-di-butylamino ethyl acrylamide, N,N-di-butylamino butyl methacrylamide, N,N-di-butylamino butyl ethacrylamide, N,N-di-butylamino butyl acrylamide, N,N-di-benzylamino methyl methacrylamide, N,N-di-benzylamino methyl acrylamide, N,N-di-benzylamino ethyl methacrylamide, N,N-di-benzylamino ethyl ethacrylamide, N,N-di-benzylamino ethyl acrylamide, and combinations thereof;

(ii) a second monomer that is acidic and that is capable of forming an anionic charge in the compositions;

(iii) optionally, a third monomer that has an uncharged hydrophilic group; and (iv) optionally, a fourth monomer that is hydrophobic;

(b) optionally, an organic solvent; and (c) a surfactant; and (d) optionally, an adjuvant, wherein the mole ratio of the first monomer to the second monomer ranges from 19:1 to 4:1 or from 1:4 to 1:10.

2. The cleaning composition of claim 1 wherein the copolymer includes the third monomer and the mole ratio of the third monomer to the first monomer ranges from 9:1 to 1:9.

3. The cleaning composition of claim 1 wherein the copolymer includes the fourth monomer and the mole ratio of the fourth monomer to first monomer ranges from 9:1 to 1:9.

4. The cleaning composition of claim 1 wherein said copolymer is capable of forming an invisible film on a treated surface having a thickness of less than 1 nm on said treated surface after a cleaning operation.

5. The cleaning composition of claim 1 wherein the second monomer is selected from the group consisting of selected from the group consisting of alkyl carboxylic acids, alkyl sulfonic acids, alkyl phosphonic acids, monomers derived from maleic anhydride, monomers derived from succinic acid, acrylic acid, alkyl acrylic acid, aryl acrylic acid, vinylsulfonic acid, benzenesulfonic acid, phenylsulfonic acid, styrenesulfonic acid, sulfomethylacrylate, sulfoethylacrylate, acrylamide alkyl (alkane)sulfonic acid, acrylamide di-alkyl (alkane)sulfonic acid, acrylamide aryl (alkane)sulfonic acid, acrylamide di-aryl(alkane)sulfonic acid, acrylamide, and combinations thereof wherein said alkyl moiety is a radical independently selected from the group consisting of a C1 to C6 saturated alkyl, vinyl, C3 to C6 unsaturated alkylene radical, and combinations thereof wherein said aryl moiety is a radical independently selected from the group consisting of a benzyl, phenyl, styryl, hydroxyphenyl, alkylbenzyl, alkylphenyl radical, and combinations thereof wherein said alkane moiety is a linker group having the structure $—(CH_2)_n—$ where n=1 to 6.

6. The cleaning composition of claim 1 comprising the third monomer that is selected from the group consisting of vinyl alcohol, vinyl acetate, hydroxyethylacrylate, alcohol ethoxylate esters, alkylpolyglycoside esters, polyethylene glycol esters of acrylic or methacrylic acid, and combinations thereof.

7. The cleaning composition of claim 1 wherein the copolymer includes the fourth monomer that is selected from the group consisting of C1-C12 alkyl esters of acrylic acid, C1-C12 alkyl esters of methacrylic acid, and combinations thereof.

8. The cleaning composition of claim 1 wherein said surfactant is a nonionic surfactant.

9. The cleaning composition of claim 8 further comprising at least one of an organic solvent and an adjuvant selected from the group consisting of buffering agents, builders, hydrotropes, fragrances, dyes, colorants, solubilizing materials, stabilizers, thickeners, defoamers, enzymes, bleaching agents, cloud point modifiers, preservatives, and mixtures thereof.

10. The cleaning composition of claim 1 wherein the copolymer comprises from 0.01% to 20% by weight of the cleaning composition.

11. The cleaning composition of claim 8 wherein the surfactant comprises from 0.01% to 10% by weight of the cleaning composition.

12. The cleaning composition of claim 9 wherein the solvent comprises from 0.50% to 10% by weight of the cleaning composition.

* * * * *